United States Patent [19]

Kato et al.

[11] 4,396,151

[45] Aug. 2, 1983

[54] FUEL INJECTION SYSTEM FOR INTERNAL COMBUSTION ENGINES

[75] Inventors: Masaaki Kato, Kariya; Katashi Okamoto, Asahimachi, both of Japan

[73] Assignee: Nippondenso Co., Ltd., Kariya, Japan

[21] Appl. No.: 267,368

[22] Filed: May 26, 1981

[30] Foreign Application Priority Data

Jun. 5, 1980 [JP] Japan ..... 55-76508

[51] Int. Cl.[3] ..... F02M 59/34; F02M 61/00

[52] U.S. Cl. ..... 239/89; 123/510; 123/514; 239/90; 239/91; 239/95; 239/124

[58] Field of Search ..... 239/88–96, 239/124, 126, 533.2–533.12, 584; 123/446, 447, 510–512, 514

[56] References Cited

U.S. PATENT DOCUMENTS 4,129,253 12/1978 Bader et al. ..... 239/88

4,281,792 8/1981 Sisson et al. ..... 239/95 X

*Primary Examiner*—Andres Kashnikow

*Attorney, Agent, or Firm*—Cushman, Darby & Cushman

[57] ABSTRACT

A fuel injection system for an internal combustion engine, comprising cylinder which has a delivery plunger slidable therein, an injection plunger which is hydraulically actuated by the delivery plunger and which defines an injection pump chamber, a timing plunger which defines a timing pump chamber selectively connected to a drain and which is hydraulically actuated by the delivery plunger to control the connection of the timing pump chamber to the drain, a controllable electromagnetic control valve, balance timing orifice, non-return valve, fuel passage and metering groove feeding the fuel into the injection and timing pump chambers, and nozzle for injecting the fuel delivered by the injection pump chamber, the injection plunger and timing plunger being axially displaced by the fuel fed into the respective pump chambers, in directions opposite to the directions of the movement of the two plungers caused by the delivery plunger, through a stroke in proportion to the amount of the fed fuel.

10 Claims, 2 Drawing Figures

FUEL INJECTION SYSTEM FOR INTERNAL COMBUSTION ENGINES

This invention relates to a fuel injection system for an internal combustion engine and in particular to a unit injector system for feeding fuel to a diesel engine.

There is known an orifice control type of fuel control system in a unit injector system. In this fuel control system, the amount of fuel to be fed, which is pressurized at a predetermined pressure, is controlled by an inlet orifice, and, then, the fuel is fed into a pump chamber of a plunger pump. The plunger of the plunger pump is driven by the engine to inject the fuel into a combustion chamber of the engine.

There is also known a hydraulic system for driving the plunger with the help of the highly pressurized fuel. In this hydraulic system, a pump is driven independently of the drive of the fuel injection device to feed a highly pressurized fuel to a pressure increasing piston behind the plunger in order to drive the latter, thereby to inject the fuel.

However, in this orifice type of fuel control system, since the plunger is always moved by a constant stroke, bubbles are produced in the pump chamber during a partial load of the engine, so that the amount of the fuel injected is unstable and an undesirable injection such as a secondary injection occurs, and in addition thereto, the injection timing is delayed. Furthermore, in the known fuel control system, no injection timing can be controlled in accordance with the number of revolutions and the load, of the engine.

In a plunger driving hydraulic system as mentioned above, it is necessary to always feed a highly pressurized fuel, so that the engine is subject to a load due to the high pressure of the fuel, resulting in a large decrease of the engine output and of the durability of the high pressure hydraulic circuit.

The object of the present invention is, therefore, to eliminate the drawbacks mentioned above by providing an engine driven fuel injection system in which an injection plunger of a plunger pump is displaced by a stroke corresponding to the amount of the fuel to be fed and the amount of fuel corresponding to a predetermined injection timing can be fed to move a timing plunger by a stroke corresponding to the amount of fuel to be fed, to prevent bubbles from being produced in the pump chamber, thus resulting in no occurrence of undesirable injections. The injection timing can be optionally set. A delivery plunger of the plunger pump for producing a hydraulic pressure driving the timing plunger and the injection plunger is driven by the engine, so that it is not necessary to provide a high pressure source such as a pump which always maintains a high hydraulic pressure, thus resulting in no decrease of the engine output and no provision of the high pressure hydraulic circuit.

Figure 1:
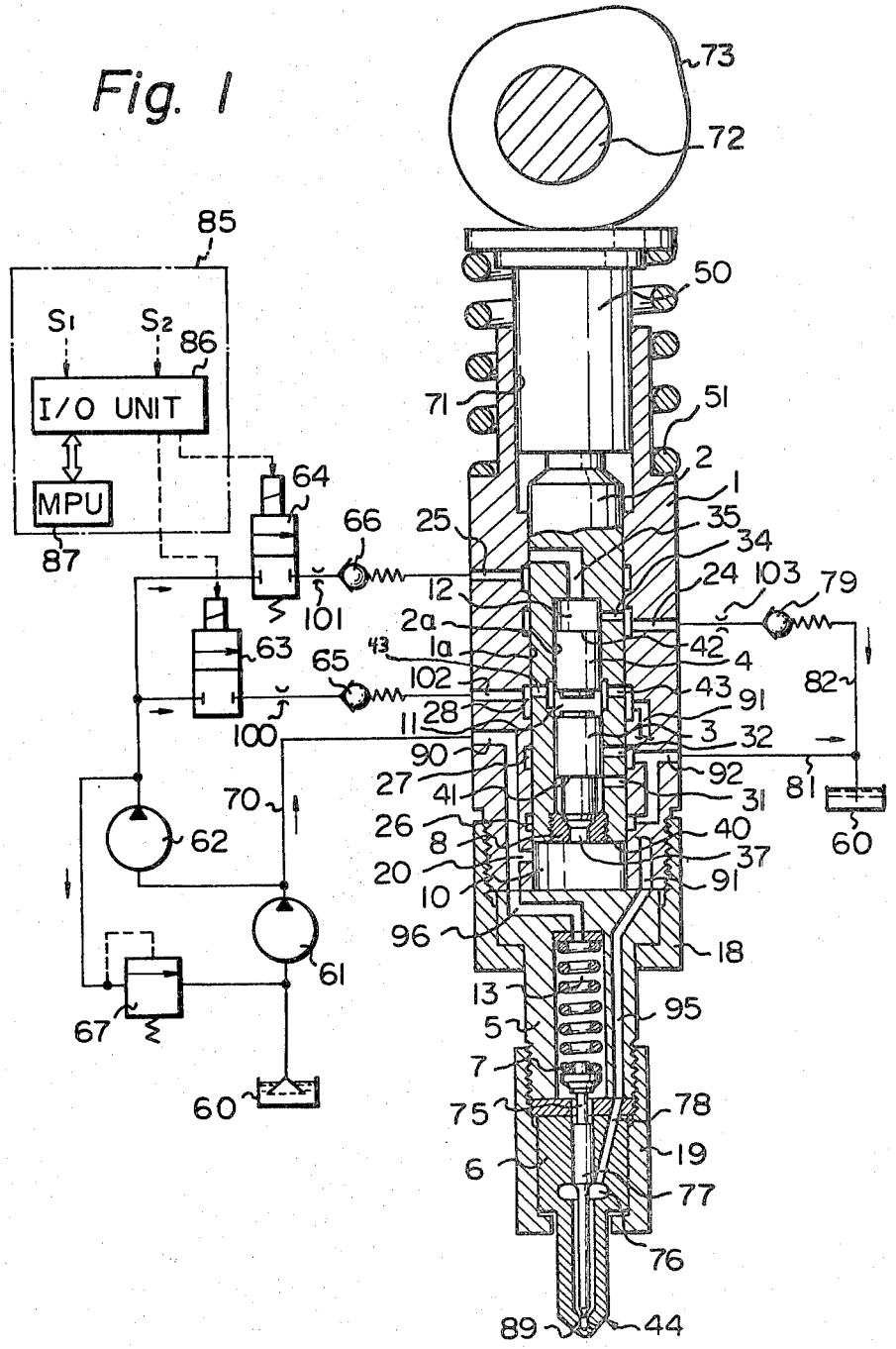
Figure 2:
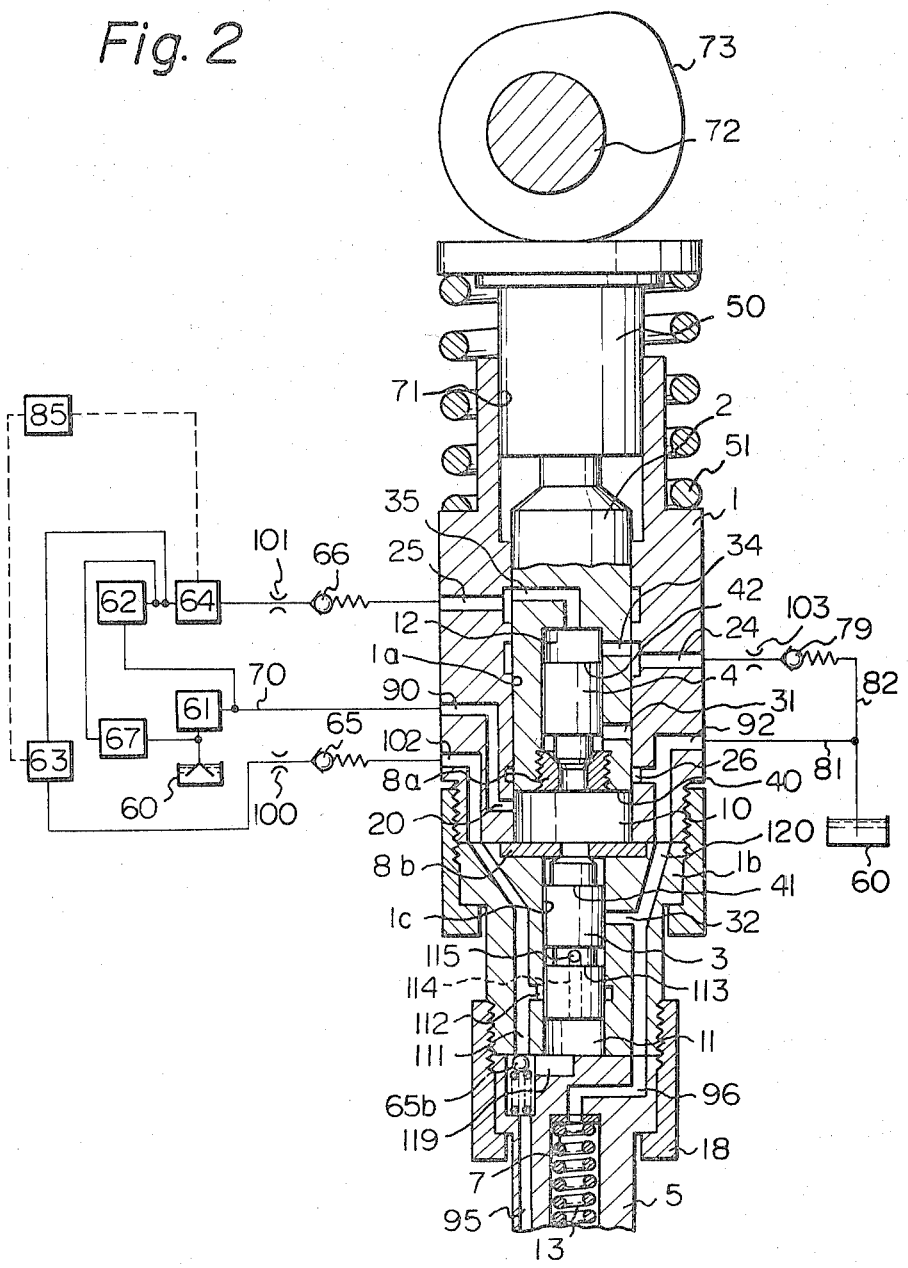

In the detailed description of the preferred embodiments of the invention presented below, reference is made to the accompanying drawings, in which:

FIGS. 1 and 2 are longitudinal sectional views of different embodiments of a fuel injection system according to the present invention.

In FIG. 1 which shows an embodiment of the present invention, a fuel injection system has cylinder 1 having an axial cylinder bore 1*a* in which a delivery plunger 2 is slidably fitted. The cylinder 1 forms an injector body. The delivery plunger 2 has an axial bore 2*a* in which an injection plunger 3 and a timing plunger 4 are slidably fitted. A nozzle holder 5 is mounted onto the bottom of the cylinder 1 by means of a nut 18. In the bottom end of the delivery plunger 2 there is screwed a stop 8 which is adapted to limit the downward movement of the injection plunger 3 and which has an axial center hole 37. A nozzle assembly 6 is integrally connected to the nozzle holder 5 by means of a nut 19 screwed on the nozzle holder 5. The cylinder 1 is provided on its top, with a bore 71 in which a cam follower 50 is slidably inserted. The cam follower 50 is connected to the delivery plunger 2. A return spring 51 is arranged between the cylinder 1 and the cam follower 50 to move the latter. A cam 73 which rotates with a cam shaft 72 synchronously driven by an engine (not shown) bears against the cam follower 50, so that when the cam 73 rotates, the cam follower 50 moves downwards. The cam follower 50 is returned upwards by the return spring 51.

The delivery plunger 2 has a metering lead 40 which is adapted to open and close a metering port 20 formed in the cylinder 1 and a spill port 31 which comes in communication with an annular spill groove 26 formed in the cylinder 1 when the delivery plunger 2 moves downward.

An injection pump chamber 11 defined in the delivery plunger 2 between the injection plunger 3 and the timing plunger 4 is connected to a fuel passage 102 and a delivery passage 91 formed in the cylinder 1, by means of a lateral holes 43 formed in the delivery plunger 2 and an annular metering groove 28 formed in the cylinder 1. The delivery passage 91 is connected to a fuel storage chamber 76 in the nozzle assembly 6 by means of a fuel passage 95 formed in the nozzle holder 5 and by means of a fuel passage 78 formed in the nozzle assembly 6.

A timing pump chamber 12 defined in the delivery plunger 2 by the timing plunger 4 is connected not only to a drain passage 24 formed in the cylinder 1 by means of a timing port 34 formed in the delivery plunger 2, but also to a fuel passage 25 formed in the cylinder 1 by means of a fuel passage 35 formed in the delivery plunger 2. The delivery plunger 2 has a pressure escaping port 32 which is opened and closed by a pressure escaping lead 41 formed on the injection plunger 3 and which can be connected to a delivery pump chamber 10 defined in the cylinder 1 by the delivery plunger 2 and to an annular pressure escaping groove 27 formed in the cylinder 1. The timing plunger 4 has a timing lead 42 which is adapted to open and close the timing port 34.

The fuel in a fuel tank 60 is pumped by a first fuel feed pump 61 which is driven by the engine (not shown) and is then fed into the delivery pump chamber 10 by means of a feed pipe 70 and a passage 90 which is provided in the cylinder 1 and which is connected to the metering port 20.

A part of the fuel fed from the first fuel feed pump 61 is further pressurized by a second fuel feed pump 62 driven by the engine (not shown). The pressure of the further pressurized fuel is controlled by a fuel pressure regulator 67 where the pressure is maintained at a constant value. The pressure controlled fuel is then fed into the injection pump chamber 11 by means of a first electromagnetic control valve 63 which is controlled by a control circuit 85 so that it operates to open in response to signals $S_1$, $S_2$ representing the engine load ($S_1$), engine speed ($S_2$) or the like, a balance orifice 100 which ensures the feed of an equal amount of fuel into the engine cylinders (not shown), a non-return valve 65, the fuel passage 102 in the cylinder 1, and the metering groove 28.

A part of the pressure controlled fuel is fed into the timing pump chamber 12, by means of a second electromagnetic control valve 64 similar to the first electromagnetic control valve 63, a timing orifice 101 which is adapted to eliminate a difference in injection timing between the engine cylinders (not shown), a non-return valve 66, the fuel passage 25 in the cylinder 1, and the fuel passage 35 in the delivery plunger 2.

The control circuit 85 is per se known, which includes an input-output unit (I/O unit) 86 having various kinds of interface circuits (not shown) and a micro processor unit (MPU) 87 which has a memory (not shown) storing a predetermined program and which operates in accordance with the program.

The nozzle assembly 6 is per se known, which is composed of a needle valve 77 with a valve stem 75 which controls a nozzle port opening 89 from which the fuel is ejected. The valve stem 75 is biassed into a closed position of the needle valve 77 by a nozzle spring 7 which is arranged in a nozzle spring chamber 13 formed in the nozzle holder 5. The nozzle spring chamber 13 is connected to the fuel passage 90 by means of a connecting passage 96 formed in the nozzle holder 5.

The spill groove 26 and the pressure escaping groove 27, of the cylinder 1 are connected to the fuel tank 60 by means of a discharge passage 92 formed in the cylinder 1 and a drain pipe 81. The drain passage 24 is connected to the fuel tank 60 by means of a drain pipe 82 which has therein an orifice 103 and a non-return valve 79. The unit injector shown in FIG. 1 can be mounted to a cylinder head (not shown) of the associated engine with the help of the cylinder 1 or the nozzle holder 5 in such a way that the front end of the nozzle assembly 44 extends into a combustion chamber (not shown) of the engine.

The unit injector according to the present invention operates as follows.

The timing pump chamber 12 is filled with a predetermined amount of fuel corresponding to a preset injection timing and the timing plunger 4 remains stationary in the cylinder bore 2*a* of the delivery plunger 2 at its initial lower position which depends on the injection timing. The injection pump chamber 11 is filled with a predetermined amount of fuel to be ejected from the nozzle assembly and the injection plunger 3 remains stationary in the cylinder bore 2*a* of the delivery plunger 2 at its initial lower position depending on the injection timing and the amount of fuel to be ejected. When the delivery plunger 2 is displaced downwards by the rotation of the cam 73, the metering port 20 is closed by the metering lead 40. When the metering port 20 is closed, the fuel in the delivery pump chamber 10 begins to be pressurized, so that the pressure acts on the injection plunger 3. Consequently, the injection plunger 3 is displaced upwards, so that the injection pump chamber 11 is compressed. The increased pressure of the injection pump chamber 11 causes the timing plunger 4 to move upwards in order to discharge the fuel in the timing pump chamber 12 into the tank 60 by means of the timing port 34, the drain passage 24, the orifice 103, and the non-return valve 79. When the timing port 34 is closed by the timing lead 42, the discharge of the fuel from the timing port 34 is stopped. Further downward movement of the delivery plunger 2 increases the fuel pressure in the delivery pump chamber 10, the injection pump chamber 11, and the timing pump chamber 12, so that the fuel in the injection pump chamber 11 is ejected from the nozzle opening 89, through the lateral hole 43 of the delivery plunger 2, the delivery passage 91 of the cylinder 1 and the fuel passage 95 of the nozzle holder 5. It should be noted that the injection plunger 3 is displaced at a speed which is higher than that of the movement of the delivery plunger 2 by a value depending on the difference in the cross sectional areas (pressure receiving area) of the delivery plunger 2 and the injection plunger 3. By further downward movement of the delivery plunger 2, the pressure escaping lead 41 of the injection plunger 3 causes the pressure escaping port 32 to open, so that the fuel in the delivery pump chamber 10 is discharged into the fuel tank through the discharge passage 92 and the drain pipe 81. Consequently, the pressure of the delivery pump chamber 10 is decreased, so that the injection plunger 3 stops moving to complete the fuel injection. The delivery plunger 2 continues to move downwards while discharging the fuel in the delivery pump chamber 10, after the injection plunger 2 stops, so that the spill port 31 is connected to the spill groove 26. When the connection between the spill port 31 and the spill groove 26 is established the fuel in the delivery pump chamber 10 is discharged also from the spill groove 26, and, consequently, the compression stroke of the delivery plunger 2 is completed. The delivery plunger 2 further moves slightly downwards until it reaches its bottom dead point.

The amount of the pressure controlled fuel from the second fuel feed pump 62 is controlled by the second electromagnetic valve 64 which opens for a predetermined period of time corresponding to the fuel injection timing and is then fed into the timing pump chamber 12, so that the timing plunger 4 is moved downwards to move the injection plunger 3 by means of the fuel in the injection pump chamber 11. As a result of the downward movement of the injection plunger 3, the fuel in the delivery pump chamber 10 is discharged from the spill port 31 and the spill groove 26, into the fuel tank 60.

Then, the first electromagnetic valve 63 opens to feed a predetermined amount of fuel to be fed, into the injection pump chamber 11 by means of the non-return valve 65 and the fuel passage 102, so that the injection plunger 3 is displaced downward by a stroke corresponding to the amount of fuel to be ejected from the nozzle assembly. At this time, the fuel in the delivery pump chamber 10 is discharged into the fuel tank 60.

As can be understood from the above discussion, on one hand, the fuel injection timing is controlled by the period of time during which the second electromagnetic valve 64 opens, and, on the other hand, the amount of fuel to be fed is controlled by the period of time during which the first electromagnetic valve 63 opens. Therefore, an optimum amount of fuel can be easily ejected from the nozzle at an optimum injection timing, by properly controlling the period of time during which the electromagnetic valves 63 and 64 open, in accordance with the engine load or the like. The maximum amount of fuel to be ejected can be obtained when the timing port 34 is closed by the timing plunger 4 at the end of the control of the amount of fuel to be fed and when the injection plunger 3 bears against the injection plunger stop 8. Since a maximum advance of the ignition timing is obtained when timing port 34 is closed by the timing plunger 4, the engine can be easily started.

The compression stroke of the delivery plunger 2 is slightly larger than the stroke of the injection plunger 3 necessary for obtaining the maximum amount of fuel to be fed.

When a predetermined amount of fuel is fed into the injection pump chamber 11 and the timing pump chamber 12, the delivery plunger 2 is then moved upwards. During the movement of the delivery plunger 2, the spill port 31 is first disconnected from the spill groove 26 and then the metering lead 40 causes the metering port 20 to open. During this movement of the delivery plunger 2, bubbles occur in the delivery pump chamber 10, since the air in the delivery pump chamber 10 is compressed. However, these bubbles are broken or disappear when the metering port 20 opens so that the fuel is fed into the delivery pump chamber 10 from the first fuel feed pump 61. Therefore, when the delivery plunger 2 stops at its top dead point, the delivery pump chamber 10 is filled with fuel which contains no bubble. Thus, the delivery plunger is prepared for the subsequent compression stroke.

In the illustrated embodiment, the second electromagnetic valve 64 first opens and then the first electromagnetic valve 63 opens. However, the order of operation of the two electromagnetic valves is reversible. Alternatively, it is also possible to actuate the valves at one time. Although the valves preferably begin to open when the delivery plunger 2 remains stationary at its bottom dead point, it is also possible to open the valves during the upward movement of the delivery plunger 2 or when the latter remains stationary at its top dead point.

FIG. 2 shows another embodiment of the present invention, in which components corresponding or equivalent to the components shown in FIG. 1 are designated by the same numerals as those in FIG. 1. The explanation of the embodiment illustrated in FIG. 2 will be given below and is mainly directed to differences between FIGS. 1 and 2.

In FIG. 2, the injector body is composed of two cylinders 1 and 1*b*. The second cylinder 1*b* which is connected to the first cylinder 1 has a cylinder bore 1*c* in which the injection plunger 3 is slidably fitted. The injection pump chamber 11 is defined in the second cylinder 1*b* between the injection plunger 3 and the nozzle holder 5 which is rigidly connected to the second cylinder 1*b* by means of the nut 18. The injection plunger 3 additionally has a spill lead 113 and an axial hole 114 and a cross hole 115 connected to the axial hole 114. The second cylinder 1*b* has a spill port 112 and a fuel passage 120 connecting the connecting passage 96 of the nozzle holder 5 to the discharge passage 92 of the cylinder 1. The leaked fuel from the nozzle assembly 6 is discharged into the fuel tank 60 by means of the connecting passage 96, the fuel passage 120 and the discharge passage 92. The fuel passage 102 is connected to the injection pump chamber 11 by means of a fuel passage 111 formed in the second cylinder 1*b* and a fuel passage 119 formed in the nozzle holder 5. In the fuel passage 119 there is arranged a non-return valve (ball valve) 65*b* which allows the fuel to flow only from the passage 111 into the injection pump chamber 11. To the bottom of the delivery plunger 2 there is attached a first stop 8*a* which is adapted to limit the downward movement of the timing plunger 4. Between the first and second cylinders 1 and 1*b* there is arranged a second stop 8*b* which is adapted to limit the upward movement of the injection plunger 3.

According to the embodiment illustrated in FIG. 2, the length of the fuel passage between the injection pump chamber 11 and the nozzle assembly 6 is shorter than that in FIG. 1, because the injection pump chamber 11 is located closer to the nozzle assembly 6 in comparison with FIG. 1, and, accordingly, the delay of injection due to the presence of a long fuel passage between the injection pump chamber 11 and the nozzle assembly 6 can be decreased and the injection pressure can be increased. When the injection is completed, the fuel in the injection pump chamber 11 is discharged into the fuel passage 111 by means of the axial hole 114 and the cross hole 115 of the injection plunger 3 and the spill port 112 of the second cylinder 1*b*. Therefore, a rapid completion of the injection can be provided. The amount of fuel corresponding to the amount of the fuel spilled from the injection pump chamber 11 is fed again from the spill port 112 into the injection pump chamber after the completion of the fuel injection, so that the injection plunger is moved upward by a displacement corresponding to the spill stroke, resulting in a high efficiency of utilization of the fuel. Furthermore, the feed of the spilled fuel from the delivery pump chamber 10 into the nozzle spring chamber 13 contributes to a faster completion of the fuel injection.

It should be noted that two fuel feed pumps 61 and 62 are provided in the illustrated embodiments, but these pumps can be replaced by a single feed pump which feeds the fuel to the three pump chambers 10, 11 and 12.

It is possible to provide a fuel pressure regulator 67 which controls the fuel pressure in accordance with the number of revolutions of the associated engine in order to control the amount of fuel to be fed in accordance with the number of revolutions.

The two electromagnetic valves 63 and 64 can be replaced by a two-position and a three-port or a four-port type of single electromagnetic valve. The location of the injection plunger 3 and the timing plunger 4 can be reversed. Only one of two plungers i.e. the injection plunger 3 and the timing plunger 4 can be arranged in the cylinder bore 2*a* of the delivery plunger 2, instead of the arrangement of the two cylinders in the cylinder bore 2*a*. It is also possible to put the timing plunger 4 in the injection plunger 3 and vice versa. Alternatively, it is also possible to provide separate cylinders in which the respective plungers 2, 3 and 4 are individually arranged.

As can be understood from the above discussion, according to the present invention, since the injection plunger is displaced by a stroke proportionally corresponding to the amount of fuel fed, no bubble occurs in the injection pump chamber, resulting in the prevention of an undesirable injection, such as a secondary injection, and in the prevention of the fluctuation of the amount of fuel to be ejected. In addition, according to the present invention, the injection timing can be optionally set by controlling the fuel to be fed into the timing pump chamber causing the timing plunger to move. Furthermore, since the delivery plunger is driven by the associated engine, no provision of a high pressure source, such as a hydraulic pump which maintains a high pressure acting on the delivery plunger is necessary, thus resulting in no provision of a high pressure hydraulic circuit and no decrease of the engine output.

We claim:

1. A fuel injection system for an internal combustion engine, comprising a substantially cylindrical injector body having a cylinder which has an engine driven delivery plunger slidable therein, an injection plunger which is hydraulically actuated by the delivery plunger and which defines at its one end an injection pump chamber, a timing plunger which defines, at its one end, a timing pump chamber selectively connected to a drain and which is hydraulically actuated by the delivery plunger to control the connection of the timing pump chamber to the drain, means for feeding the fuel into the injection and timing pump chambers, and nozzle means for injecting the fuel delivered by the injection pump chamber, said injection plunger and timing plunger being axially displaced by the fuel fed into the respective pump chambers, in directions opposite to directions of the movement of the two plungers caused by the delivery plunger, through a stroke in proportion to the amount of the fed fuel, the fuel being delivered from the injection plunger into the nozzle means when the timing plunger causes the timing pump chamber to be disconnected from the drain.

2. A fuel injection system according to claim 1, wherein said fuel feeding means comprises at least one fuel feed pump.

3. A fuel injection system according to claim 2, wherein said fuel feeding means comprises fuel passage means for connecting the fuel feed pump(s) to the injection and timing pump chambers.

4. A fuel injection system according to claim 1, further comprising at least one fuel control valve means in the fuel passage means for controlling the amount of fuel passing therethrough to be fed into the injection pump chamber.

5. A fuel injection system according to claim 1, further comprising nozzle holder means for holding said nozzle means.

6. A fuel injection system according to claim 5, wherein said nozzle holder means is rigidly connected to the cylinder.

7. A fuel injection system according to claim 1, wherein said delivery plunger has a cylinder bore in which the injection plunger and the timing plunger are coaxially and slidably arranged.

8. A fuel injection system according to claim 7, wherein said timing plunger 4 defines, at its one end, the timing pump chamber in the cylinder bore of the delivery plunger and defines, at the other end, the injection pump chamber between the timing plunger and the injection plunger.

9. A fuel injection system according to claim 1, wherein said injector body has first and second cylinders connected to each other, said first cylinder having a cylinder bore in which the delivery plunger is slidably fitted, said delivery plunger having a cylinder bore in which the timing plunger is slidably fitted, the second cylinder having a cylinder bore in which the injection plunger is slidably fitted.

10. A fuel injection system according to claim 9, wherein the injection pump chamber is provided between the nozzle means and the injection plunger, in the cylinder bore of the second cylinder.

* * * * *